United States Patent [19]

Arnold et al.

[11] Patent Number: 4,806,107

[45] Date of Patent: Feb. 21, 1989

[54] HIGH FREQUENCY CONNECTOR

[75] Inventors: Richard M. Arnold, New Albany; Paul A. Baker, Columbus, both of Ohio; Coleen A. Drucker, Morristown, N.J.; Robert J. Gashler, Westerville; Dominic T. Lipari, Reynoldsburg, both of Ohio; Max S. Robin, Denville, N.J.; Howard C. Schell, Westerville, Ohio

[73] Assignee: American Telephone and Telegraph Company, AT&T Bell Laboratories, Murray Hill, N.J.

[21] Appl. No.: 112,193

[22] Filed: Oct. 16, 1987

[51] Int. Cl.[4] ..... H01R 13/658

[52] U.S. Cl. ..... 439/79; 439/101; 439/608

[58] Field of Search ..... 439/67, 79, 80, 77, 439/92, 95, 96, 101, 108, 284–294, 607–610

[56] References Cited

U.S. PATENT DOCUMENTS

| | | | |
|---|---|---|---|
| 2,384,267 | 9/1945 | Andersen | 439/293 |
| 2,606,224 | 8/1952 | Modrey | 439/294 |
| 3,676,746 | 7/1972 | Kassabgi | 439/79 |
| 4,571,014 | 2/1986 | Robin et al. | 439/608 |
| 4,632,476 | 12/1986 | Schell et al. | 439/607 |
| 4,710,133 | 12/1987 | Lindeman | 439/62 |

OTHER PUBLICATIONS

*IEEE Proceedings of the Electronics Components Conference,* "Flex Header Connector with Ground Plane", by S. J. Young, pp. 55–62 (Oct. 1986).

*Primary Examiner*—Neil Abrams

*Attorney, Agent, or Firm*—Lester H. Birnbaum

[57] ABSTRACT

Disclosed is a high frequency connector employing a plurality of columns of female contacts for receiving signal carriers and ground/power blades providing shielding between the columns of female contacts. The signal and ground/power blades are coupled to a circuit pack by means of a plurality of flexible circuit sheets. The connector provides full shielding of the signal carriers to the backplane.

8 Claims, 5 Drawing Sheets

HIGH FREQUENCY CONNECTOR

BACKGROUND OF THE INVENTION

This invention relates to high frequency interconnection systems.

In a typical interconnection system, electronic components are mounted on a printed circuit board to form a circuit pack and electronically coupled to signal pins in a backplane by means of a plug-in connector which permits easy insertion and removal of the circuit packs. A problem lies in providing some means for making ground connections from the circuit pack to the backplane so that the signals are shielded.

A typical solution involves dedicating certain pins in the backplane for ground connections and providing the ground connections by some means external to the connector. It would be preferable, however, to be able to utilize all pins on the backplane for signal carrying and also to provide an integral, removable connector having signal and ground connections.

One recently proposed solution involves use of a multilayer board connector which includes signal contacts for receiving the pins of the backplane and also includes a ground conductive member which surrounds said contacts and makes ground connection to the backplane in the areas of the backplane between the pins (see, U.S. Pat. No. 4,571,014 issued to Robin et al.) Ground connection to the backplane could be made by a terminal grounding unit, which is an insulating member fitted over the pins and allowing them to protrude in order to contact the signal contacts of the circuit pack connector. The grounding unit also includes slots for receiving the ground conductive member, and u-shaped female contacts within the slots for electrically engaging the ground conductive member (see, U.S. Pat. No. 4,632,426 issued to Schell).

While such a solution is adequate, a multilayer board of that design could be expensive to manufacture.

It is therefore, an object of the invention to provide an inexpensive separable connector which includes ground connection from the circuit pack through the backplane so as to provide shielding in a high frequency application.

SUMMARY OF THE INVENTION

This and other objects are achieved in accordance with the invention which, in one aspect, is an electrical connector comprising a plurality of female conductive members arranged in a plurality of rows and columns. Also included is a plurality of male conductive members positioned between and extending beyond the female conductive members. Flexible circuit means having two ends are also provided so that one end is coupled to at least one adjacent female and male conductive members and the other end is coupled to terminal means at a portion of the connector remote from said plurality of male and female conductive members.

BRIEF DESCRIPTION OF THE DRAWING

These and other features of the inventions are delineated in detail in the following description. In the drawing.

It will be appreciated that, for purposes of illustration, these figures are not necessarily drawn to scale.

DETAILED DESCRIPTION

Figure 1:
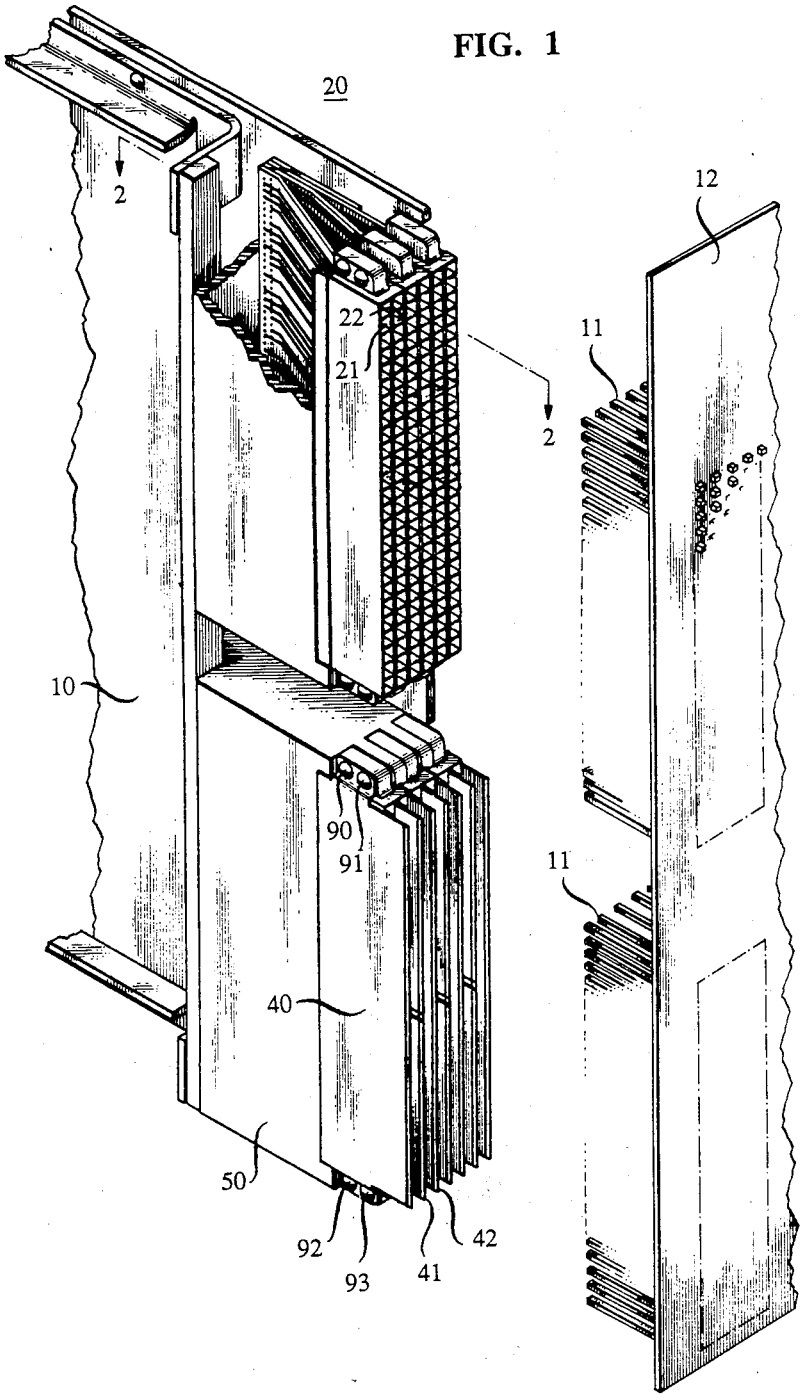
FIG. 1 is a perspective view of a high frequency interconnection system in accordance with one embodiment of the invention.

FIG. 1 gives a perspective view of some basic components of an interconnection system in accordance with the invention. The circuit pack, a portion of which is shown as 10, is electrically coupled to conductive pins, such as 11, mounted in a backplane, a portion of which is shown as 12. The circuit pack, pins and backplane are of the standard type well-known in the art and are, therefore, not discussed further.

Figure 2:
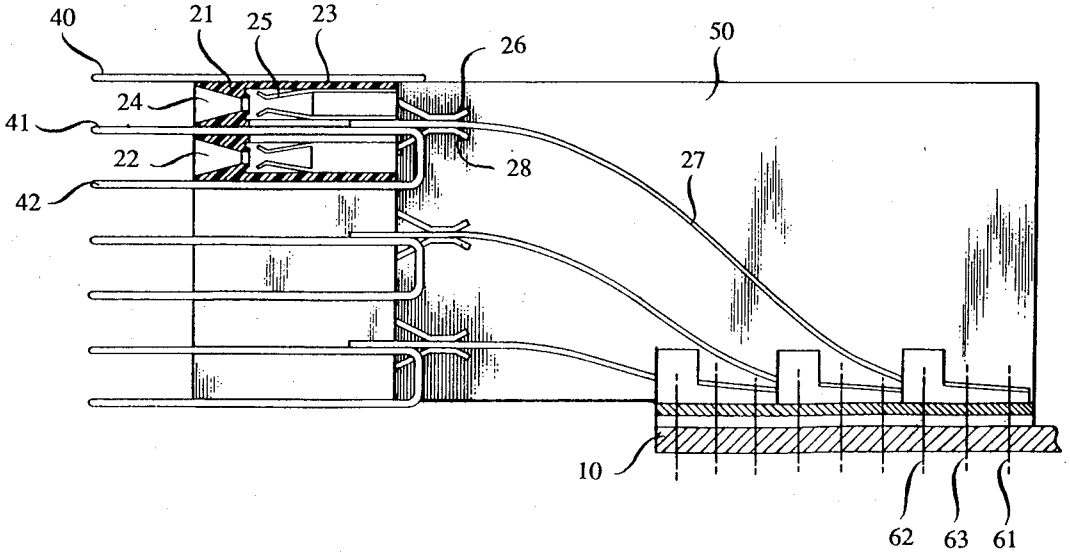
FIG. 2 is a cross-sectional schematic view of the high frequency modular connector shown in FIG. 1.

Electrical connection between the backplane and circuit pack is provided by the plug-in connctor 20, which is also illustrated in the cross-sectional, partly schematic view of FIG. 2 (taken along lines 2—2 of FIG. 1). The connector includes a plurality of rows and columns of female conductive members such as adjacent members 21 and 22. Each member (e.g. 21) includes an insulative housing, 23, with an opening, 24, therein for receiving a corresponding pin from the backplane. Also included in each housing is means, such as conductive tynes, 25, for making electrical contact to the inserted pin. The contact means terminates in a tail section, 26, extending out the end of the housing opposite to the opening 24. Each tail section is electrically coupled to a flexible circuit member, e.g. 27, by bonding the tail to one of the conductive strips (e.g., 30 of FIG. 3) on the surface of the flexible circuit. In this embodiment, the tail sections of adjacent columns of receptacles are bonded to opposite surfaces of the flexible circuit. Thus, for example, tail section 28 coupled to member 22 is bonded to a conductive strip (32 of FIG. 4) on the underside of the portion shown in FIG. 3. Each pair of adjacent columns is coupled to a different flexible circuit as shown in FIG. 2.

The female conductive members, 21 and 22 are of a standard type employing a housing, 23, made of an engineering thermal plastic and conductive tynes, 25, made of a copper alloy. The tail section, 26, is made from the same piece of metal as the tynes. The flexible circuit, 27, is usually made from a sheet comprising a dielectric material (e.g., polyimide) with conductive strips, e.g., 30 and 32 made of copper formed on both major surfaces. Holes in the circuit, such as 31, are usually made by drilling.

In order to provide shielding of the signals transmitted between the circuit pack and backplane, the connector, 20, also includes a plurality of male conductive members, e.g., 40–42, positioned between, and extending beyond, the female conductive members. (It will be noted in FIG. 1 that the male conductive members are removed from the top portions of the connector in order to illustrate the female conductive member, but the same pattern of male conductive members exists on both portions.) In this embodiment, the male conductive members are metal blades approximately 0.015 inches thick mounted between the columns of female conductive members. The outside blade, 40, is a single sheet of metal mechanically attached to plastic housing, 50, which houses the female members and flexible circuits. The remaining blades, e.g., 41 and 42, are formed from single sheets which are bent around the back ends of the female members so that each end of the sheet emerges from between two adjacent columns of female conductors (see FIG. 2). If desired, each blade could be a single flat sheet. Each such sheet also includes apertures to permit the tail sections, e.g., 28, from a column of female conductors to make contact to the flexible circuit. The sheet, e.g., blades 41 and 42, make electrical contact to the conductive layer (33 of FIG. 4) on the underside of the flexible circuit, which is the side of the flexible circuit opposite to that shown in FIG. 3. The sheet is bonded to the conductive layer on the flexible circuit by soldering or use of a conductive polymer material. The conductive layer, 33, extends to the top surface (FIG. 3) of the flexible layer through holes such as 31 to form conductive strips 34 and 35 between each conductive strip (e.g., 30) on that surface connected to a female member. Similarly, conductive strips 39 and 40 are formed to extend between the conductive strips, e.g., 32, on the opposite surface (FIG. 4).

Figure 3:
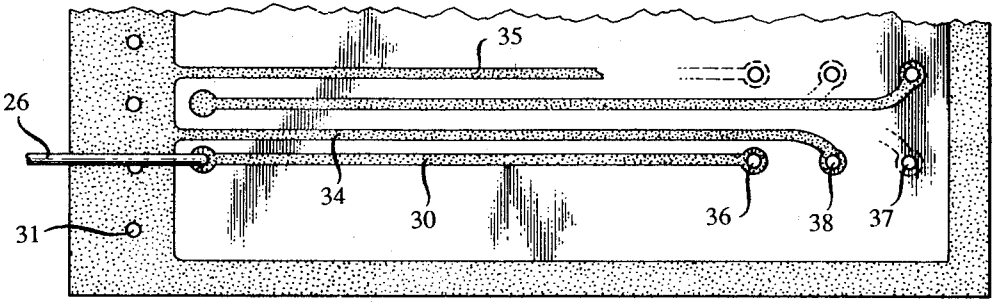
FIG. 3 is another view of a portion of the connector of FIG. 2.
Figure 4:
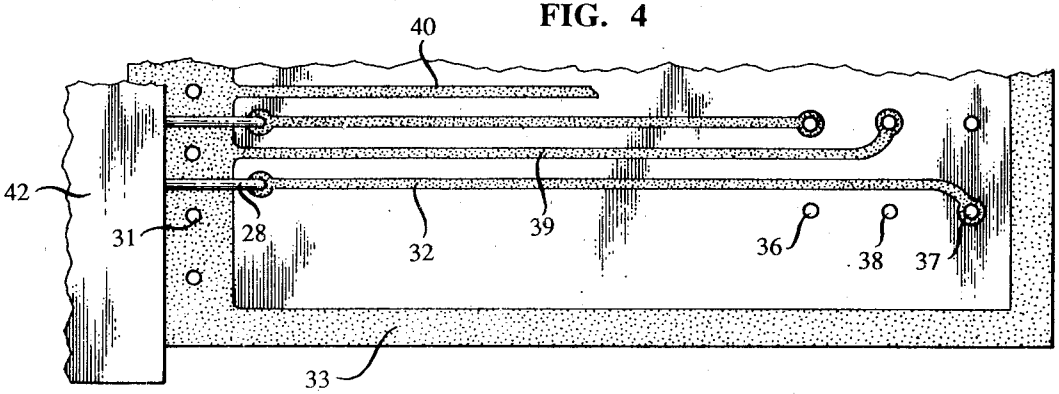
FIG. 4 is another view of a further portion of the connector of FIG. 2.
Figure 5:
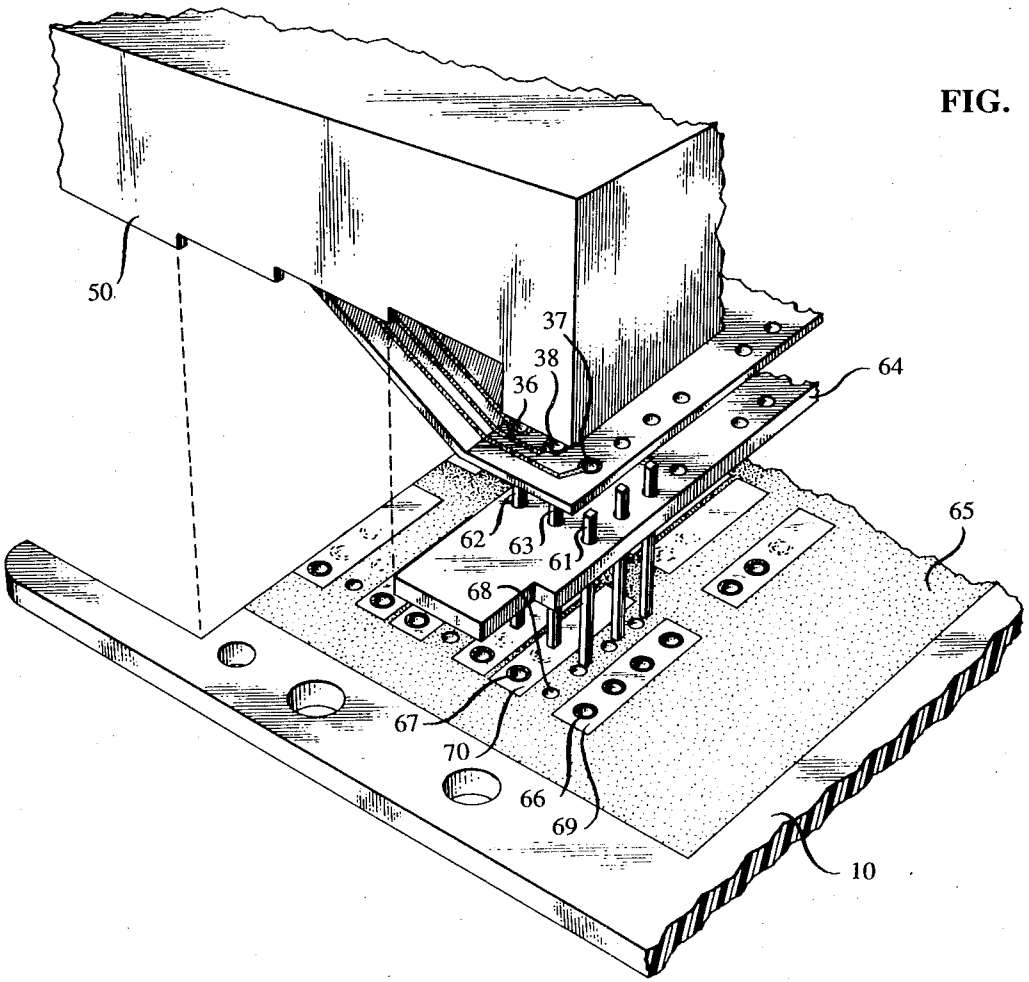
FIG. 5 is another view of a still further portion of the connector of FIG. 2.

At the end of the flexible circuit opposite to the male and female members, as shown in FIGS. 3–5, the conductive strips, e.g., 30, 32 and 34, terminate in a series of apertures with conductive side walls, e.g., 36, 37 and 38, respectively. Electrical contact is provided to the strips by pins, e.g., 61, 62 and 63 of FIG. 5, with one end inserted through the apertures. The opposite ends of the pins are inserted through holes in a coaxial pin header member 64, and through aligned holes, e.g., 66, 67 and 68, in the circuit pack 10. Direct attachment of the flexible circuit to the circuit board may also be possible. At the surface of the circuit pack substrate (printed wiring board), in the area where the connector 20 is joined to the circuit pack, is a conductive layer 65. The conductive layer, 65, is etched from portions, e.g., 69 and 70 which include some of the holes (e.g., 66 and 67).

It will be appreciated, therefore, that the blades, e.g., 41–42, provide a ground connection shield between each column of female members, e.g., 21–22, by coupling the blades to portions of a flexible circuit, e.g., 27, which, in turn, are coupled at the other end to a ground plane of the circuit pack. For example, in summary, each female member in a column, e.g., 21, is coupled to a separate conductive strip, e.g., 30, on one surface of a flexible circuit, 27. The members of the adjacent column, e.g., 22, are also coupled to individual strips, e.g., 32, but on the opposite surface of the flexible circuit. In the meantime, the blade, e.g., 41, in the space between the two columns is coupled to the conductive layer, e.g., 33, on one surface of the flexible circuit. The ground connection is brought to both surfaces of the circuit and extends to the other end of the circuit along with the signal lines on that surface. The ground and signal lines contact the circuit pack by means of rows of three pins, e.g., 61, 62 and 63, inserted in holes 36, 37 and 38 in the flexible circuit and holes 66, 67 and 68 in the circuit pack 10. The ground connections, e.g., 34, are coupled to a conductive layer 65 on the circuit pack, while signal layers, e.g., 30 and 32, are coupled to holes, 66 and 67 which may be selectively coupled to elements on the circuit pack. Each pair of adjacent columns of female members can be coupled to the circuit pack by a different flexible circuit (FIG. 2). Each row of three pins, 61–63, therefore includes a ground connection in the middle and a signal connection from each surface of the flex circuit.

Of course, the particular pattern of signal and ground connections on the circuit pack and flexible circuits can be varied. The important feature is that each signal line is shielded by a ground connection at least for the length of the connector 20 and, as described below, for the full distance from backplane 12 to the circuit pack 10.

It will be noted that outside blade 40 is not coupled directly to a flexible circuit as are the other blades, but rather, is electrically coupled to adjacent blade 41 through screws 90–93. This blade is intended to shield the column of members from an adjacent connector coupled to the same backplane, and is not a necessary element of the invention. Also, it will be noted that a portion of every other blade, e.g., 41, is split. This is due to the need for avoiding a rib member (not shown) in the molded piece which forms the plurality of female members. Again, such a feature is not necessary.

Figure 6:
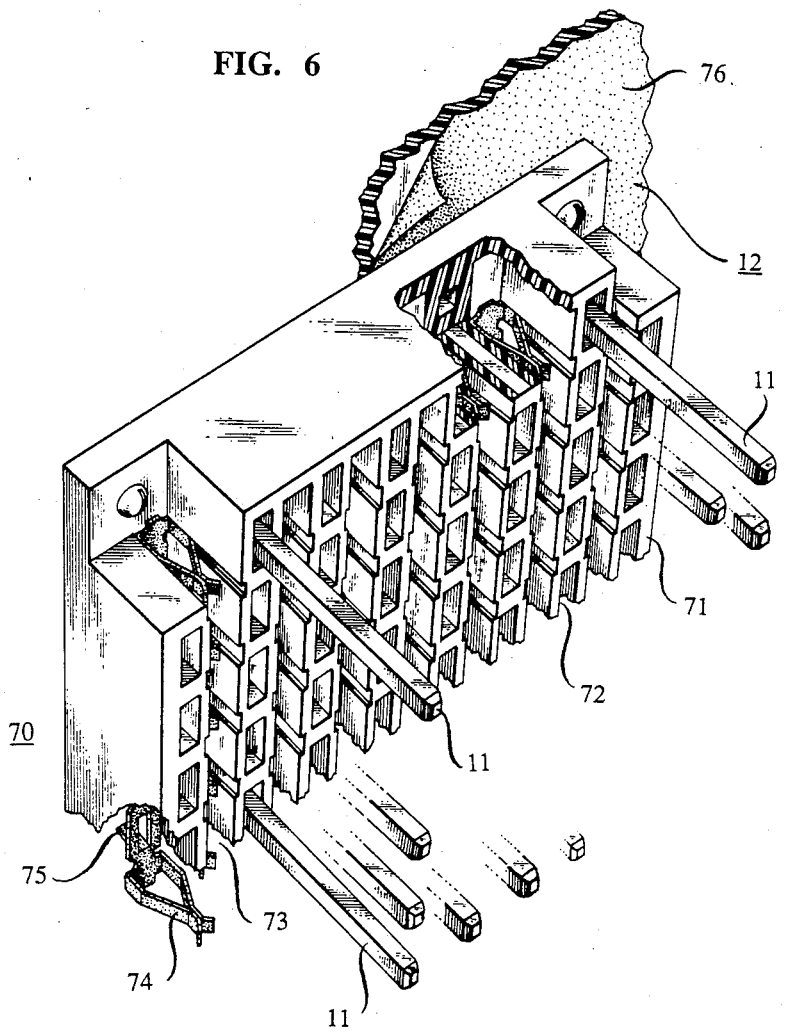
FIG. 6 is another view of a further component of the interconnection system of FIG. 1.

FIG. 6 is another view of the backplane 12 and terminal pins 11. This view also illustrates a terminal grounding unit 70 which is attached to the backplane. The unit includes an insulating housing 71, such as plastic, with a plurality of apertures, e.g., 72, which permit the pins from the backplane to protrude therethrough. (Only three of the pins are shown for the purpose of clarity in the illustration.) The unit also includes a plurality of slots, e.g., 73, positioned between columns of the apertures 72. Within each slot, a plurality of conductive tynes, e.g., 74, is mounted. The tynes are adapted to engage and electrically contact the blades (40–42 of FIG. 1) when the pins, 11, are inserted within the female members 21 and 22 of connector 20. Each tyne includes a barb 75 which makes contact with the ground conductive layer 76 on the surface of the backplane. (It will be appreciated that, although not shown, the ground layer, 75, is patterned so as to be insulated from the pins 11.)

Thus, when the connector, 20, is "plugged into" the backplane, the terminals 11 are inserted into associated female members 21 and 22 of the connector and, at the same time, the blades 40–42 make contact with tynes 74 to make electrical contact with the ground plane 76 of the backplane. A complete ground connection from the backplane to the circuit pack is therefore established.

If desired, a power connection can also be made through the blades by applying a constant potential thereto. In such cases, the blades can perform the dual function of providing power and ground shielding to reduce the need for dedicated pins on the backplane for such purposes.

Various modifications of the invention as described will become apparent to those skilled in the art. All such variations which basically rely on the teachings through which the invention has advanced the art are properly considered within the scope of the invention.

What is claimed is:

1. An electrical connector comprising:

a plurality of female conductive members arranged in a plurality of columns;

a plurality of conductive blades positioned between each column of the female conductive members and extending beyond the female conductive members; and flexible circuit means comprising a plurality of flexible circuit sheets with conductive strips on at least one major surface thereof and having two ends, the conductive strips at one end being coupled to a column of female conductive members and an adjacent conductive blade such that shielding is provided between each column of female conductive members and the other end being coupled to terminal means at a portion of the connector remote from said plurality of conductive blades and female conductive members.

2. The device according to claim 1 wherein the flexible circuit means has two major surfaces with conductive strips formed thereon, and one column of female members is coupled to the conductive strips on one surface and an adjacent column of female members is coupled to conductive strips on the opposite major surface.

3. The device according to claim 1 wherein the terminal means are adapted to make electrical contact to a printed circuit board.

4. The device according to claim 2 wherein the flexible circuit means includes, between each adjacent conductive strip, a further conductive strip coupled to conductive blade.

5. An alectrical connector comprising:

a plurality of female conductive members arranged in a plurality of columns, said members including a front end adapted to receive conductive pins and a back end;

a plurality of conductive blades positioned between each column of the female members and extending beyond the front end of the female members, adjacent blades comprising a single member folded around the back end of a column of female members;

flexible circuit means including a plurality of conductive strips formed on two major surfaces and also having two end portions, the female members of an adjacent pair of columns being coupled to a first and second plurality of strips on opposite surfaces of one end portion and the blade between said columns being coupled to a third and fourth plurality of conductive strips on both surfaces, where at least one of said third and fourth plurality of strips lies between adjacent ones of said first and second plurality of strips; and terminal means coupled to the conductive strips at the other end portion and adapted for electrical connection to a printed circuit board.

6. An electrical interconnection system comprising:

a backplane including a conductive layer on one surface, a plurality of conductive pins extending from said surface and electrically isolated from said layer, and a plurality of first female members which make electrical contact to the layer;

a connector including a plurality of columns of second female conductive members adapted to receive said pins, a plurality of blades positioned between the columns and extending beyond the second female members in order to make electrical contact with the first female members, and flexible circuit means having conductive strips on two major surfaces and having two end portions where adjacent columns of the second female members are electrically coupled to conductive strips on opposite major surfaces and each blade between said columns is coupled to conductive strips on both surfaces which lie between the conductive strips coupled to the female members, the flexible circuit means also including terminals at the other end portion making electrical contact to the strips and adapted for insertion into a printed circuit board; and a printed circuit board including means for receiving the terminals of the connector, whereby a ground connection is made from the layer of the backplane to the surface of the printed circuit board.

7. An electrical connector comprising:

a plurality of female conductive members having a front end for receiving terminal pins and a back end, said members arranged in a plurality of columns;

a plurality of conductive blades positioned between each column of female members and extending beyond the female members, at least some of said blades being folded around the back end of the female members; and flexible circuit means having two ends, with one end coupled to at least one adjacent female member and conductive blade, and the other end coupled to terminal means at a portion of the connector remote from said plurality of blades and female conductive members.

8. The device according to claim 7 wherein the blades folded around the back end of the female member and positioned between adjacent columns are coupled to a surface of the flexible circuit means.

* * * * *